US005222642A

United States Patent [19]

Solarz

[11] Patent Number: 5,222,642

[45] Date of Patent: Jun. 29, 1993

[54] ARTICLE HAVING A SELECTIVELY CHANGEABLE VISUAL DISPLAY

[75] Inventor: James J. Solarz, Deerfield, Ill.

[73] Assignee: ERO Industries, Inc., Mt. Prospect, Ill.

[21] Appl. No.: 805,306

[22] Filed: Dec. 10, 1991

[51] Int. Cl.[5] ..... A45F 5/00; A45F 5/04

[52] U.S. Cl. ..... 224/191; 224/209; 40/488; D3/32

[58] Field of Search ..... 40/488 X, 486; 150/103, 150/104, 105; 224/202, 208, 209, 210, 211; D3/32 X; 324/212, 213, 214, 215, 216, 191

[56] References Cited

U.S. PATENT DOCUMENTS

| | | | |
|---|---|---|---|
| D. 232,869 | 9/1974 | Yoshimura | D3/32 |
| D. 260,698 | 9/1981 | Fitzgerald et al. | D3/32 |
| D. 320,501 | 10/1991 | Marks | D3/32 |
| 418,135 | 12/1889 | Kaufmann | 40/491 |
| 1,250,671 | 12/1917 | Schneider | 40/491 |
| 1,474,572 | 11/1923 | Whitstock | 40/445 |
| 2,006,463 | 7/1935 | Landis | 150/104 |
| 2,302,560 | 11/1942 | Latona | 150/104 X |
| 2,345,709 | 4/1944 | Lobdell | 40/491 |
| 2,367,967 | 1/1945 | Schwartz | 40/445 |
| 2,377,414 | 6/1945 | Gold | 434/223 |
| 2,436,579 | 2/1948 | Kritchman | 150/104 |
| 3,199,238 | 8/1965 | Brown | 40/488 |
| 3,556,187 | 1/1971 | Speaky | 150/104 |
| 3,575,226 | 4/1971 | Chapman | 150/104 |
| 3,659,367 | 5/1972 | Yumoto | 40/491 |
| 3,867,971 | 2/1975 | Hazan | 150/104 |
| 4,313,270 | 2/1982 | Volkert | 40/124.1 |
| 4,381,615 | 5/1983 | Lonjmin | 40/488 X |
| 4,697,364 | 10/1987 | Dean | 40/445 |
| 4,809,453 | 3/1989 | Morgan | 40/488 |

FOREIGN PATENT DOCUMENTS

| | | | |
|---|---|---|---|
| 23258 | 6/1949 | Finland | 40/486 |
| 1042077 | of 0000 | France | 40/486 |
| 655166 | 4/1929 | France | 150/105 |
| 670891 | 12/1929 | France | 150/104 |
| 952542 | 3/1964 | United Kingdom | 150/105 |

OTHER PUBLICATIONS

Earnshaw's, "Novelty Basic Backpacks", Mar. 1985, p. 40.

*Primary Examiner*—Henry J. Recla
*Assistant Examiner*—Glenn T. Barrett
*Attorney, Agent, or Firm*—Lockwood, Alex, FitzGibbon & Cummings

[57] ABSTRACT

An article of luggage with an interior compartment and a visual display unit formed within at least one sidewall of the article. The visual display unit contains distinct first and second visual images, which are formed on separate first and second visual image components. Each component contains a plurality of first and second visual image segments which are arranged in interleaved fashion such that movement of an actuator from a first position to a second position changes the visual display of the unit from the first visual image to the second visual image.

14 Claims, 4 Drawing Sheets

ARTICLE HAVING A SELECTIVELY CHANGEABLE VISUAL DISPLAY

BACKGROUND AND SUMMARY OF THE INVENTION

The present invention relates generally to soft luggage and light weight article carriers such as backpacks, sports bags, tote bags and the like. More particularly, the present invention relates to an improved article carrier having a selectively changeable visual display unit formed within a sidewall of the article carrier which design unit is viewable from the exterior of the carrier and which may be selectively changed between a first visual image and a second visual image.

Soft luggage style article carriers, such as backpacks, sports bags and tote bags have increased greatly in the past few years as a convenient way to carry a variety of articles. Consequently, the number of styles, sizes, shapes and colors of such article carriers, and in particular backpacks, has dramatically increased to the point where the annual market for the same approaches many millions of dollars. Competition between manufacturers is intense and manufacturers frequently rely upon the display of popular and copyrighted character images to gain an edge in the marketplace. At times, the character image may influence a prospective purchaser more than the material of construction or style of construction of the article carrier.

Certain article carriers such as backpacks, include at least one closeable compartment or pouch having a planar surface panel which serves as a sidewall of the compartment which bears a visual image, most often that of a popular copyrighted character or sports team insignia. This image may be imprinted on the panel by way of screen printing or embossing.

Attempts to make elaborate visual images on backpacks and other article carriers have included as holographic images and dual image assemblies which display one of two images dependent on the vantage point of the observer. However appealing these elaborate visual images may be, once the articles leave the manufacturer, the visual designs are permanently affixed and are not changeable. Although holographic images are capable of displaying two visual images, they also rely upon the vantage point of an observer, and therefore cannot be selectively changed by the backpack wearer. An individual must purchase separate backpacks having distinct designs to have such a selection. This is a quite costly and impractical solution, particularly in the young children's market where the popularity of characters and other visual insignias may wane in a relatively short time.

The present invention provides a solution to the aforementioned problems and is directed to a article carrier, such as a backpack, which has a selectively changeable visual display assembly incorporated into a sidewall of the carrier, which display assembly permits the user to select between a first and second visual image. The display assembly includes two visual image subassemblies, or components, each of which contain a plurality of image segments separated by lateral slots. The image segments of one image component are interleaved and disposed behind the other visual image component such that one visual image is obscured by the other visual image. An actuating mechanism is provided which moves the obscured image segments into a display position whereby the second visual image is displayed and the first visual image is obscured by the segments of the second visual image. The visual display assembly is advantageously disposed within an envelope, or pocket, formed within a sidewall of the article planar panel.

It is therefore a general object of the present invention to provide an article carrier having a display unit which selectively displays a first visual image or a second visual image.

It is another object of the present invention to provide a backpack having at least one article-carrying compartment which is defined by at least one planar sidewall portion, which planar sidewall portion includes a visual display unit contained therein, the display unit being capable of displaying either a preselected first or second visual image upon movement of an actuation means.

It is yet a further object of the present invention to provide an article carrier with a selectively changeable visual display means incorporated within a sidewall of the article, the visual display means having a first visual image and a second visual image, either the first or second visual image being displayed from the article carrier sidewall upon selection by the wearer and activation of an actuation means, the first and second images being disposed on separate first and second image sheets, each on the first and second image sheets having a plurality of image strips arranged in side-by-side order to constitute a completed image when the image strips are viewed as a whole, the first image strips being interleaved with the second image strips such that the first image is viewable as a whole form the carrier panel when the actuation means is in a first operative position and, when the actuation means is moved to a second operative position, the second image is brought out of interleaved relationship and obscures the first image from view.

These and other objects, advantages and features of the present invention will become apparent from the following description of the preferred embodiment of the present invention considered in conjunction with accompanying drawings.

BRIEF DESCRIPTION OF THE DRAWINGS

During the course of this detailed description of the present invention, reference will be frequently made to the drawings in which.

DETAILED DESCRIPTION OF THE PREFERRED EMBODIMENTS

Figure 1:
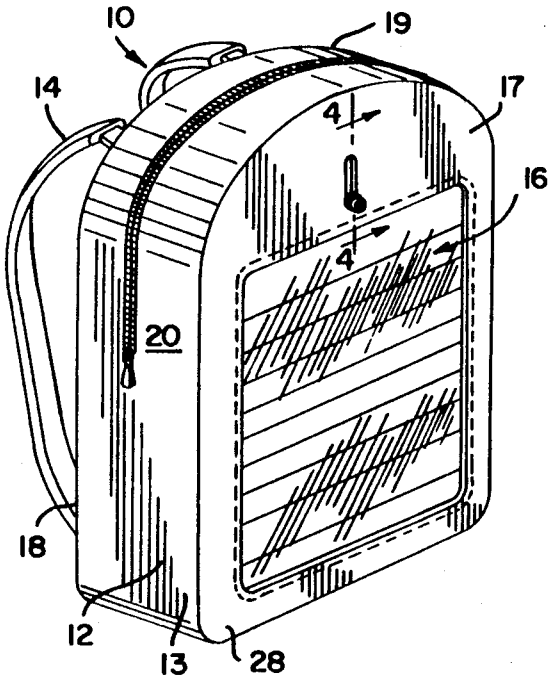
FIG. 1 is a front elevational perspective view of one preferred embodiment of a soft luggage article with a changing display unit constructed in accordance with the principles of the present invention.

Turning now to the drawings, FIG. 1 shows an article of luggage such as a backpack 10, having a display unit 16 constructed in accordance with the principles of the present invention. The backpack 10 includes a main pouch 12, and a harness having one or more straps 14. The main pouch 12 includes an article holding compartment 13 which is defined by a rear wall 18, a sidewall 20 extending around the periphery of the rear wall 18 and a front wall 28. The rear wall 18 is attached to the sidewall 20 preferably by sewing the sidewall 20 to the rear wall 18 along the peripheral edge 19 of the rear wall 18. Gluing and suitable hot melt adhesives may also be used to affix the rear wall 18 to the sidewall 20.

The article holding compartment 13 is covered by a front wall 28 having substantially the same dimensions as the rearwall 18. The front wall 28 may be affixed to the sidewall 20 by stitching the sidewall 20 and front wall 28 together along the periphery 21 of the front wall 28 to define the interior compartment 13. The backpack may be made from any suitable material including, but not limited to plastic, leather and canvas. The sidewall 20 of the article 10 may include an access means, or seam 22 that is generally disposed over the top portion of side wall 20. The seam 22 may be opened and closed, by a suitable means such as a zipper 24 which is stitched into the seam 22 allowing access to the interior compartment 13 by the user.

A selectively changeable visual display means, in the form of a visual display assembly 16 is mounted on a substantially planar portion 17 of the front wall 28. A cover panel 36 having an opening 74 therein is joined to the front wall 28 along the periphery of the cover panel 36 to define a "pocket" or an "envelope" 27 therebetween which receives and encloses the visual display assembly 16. A transparent protective plate or sheet 34 may also be disposed between the front wall 28 and its cover panel 36. The cover panel opening 74 is aligned when the display assembly 16 and its accompanying protective sheet 34 so that the images incorporated in the visual display assembly 16 are completely viewable therethrough.

Figure 2:
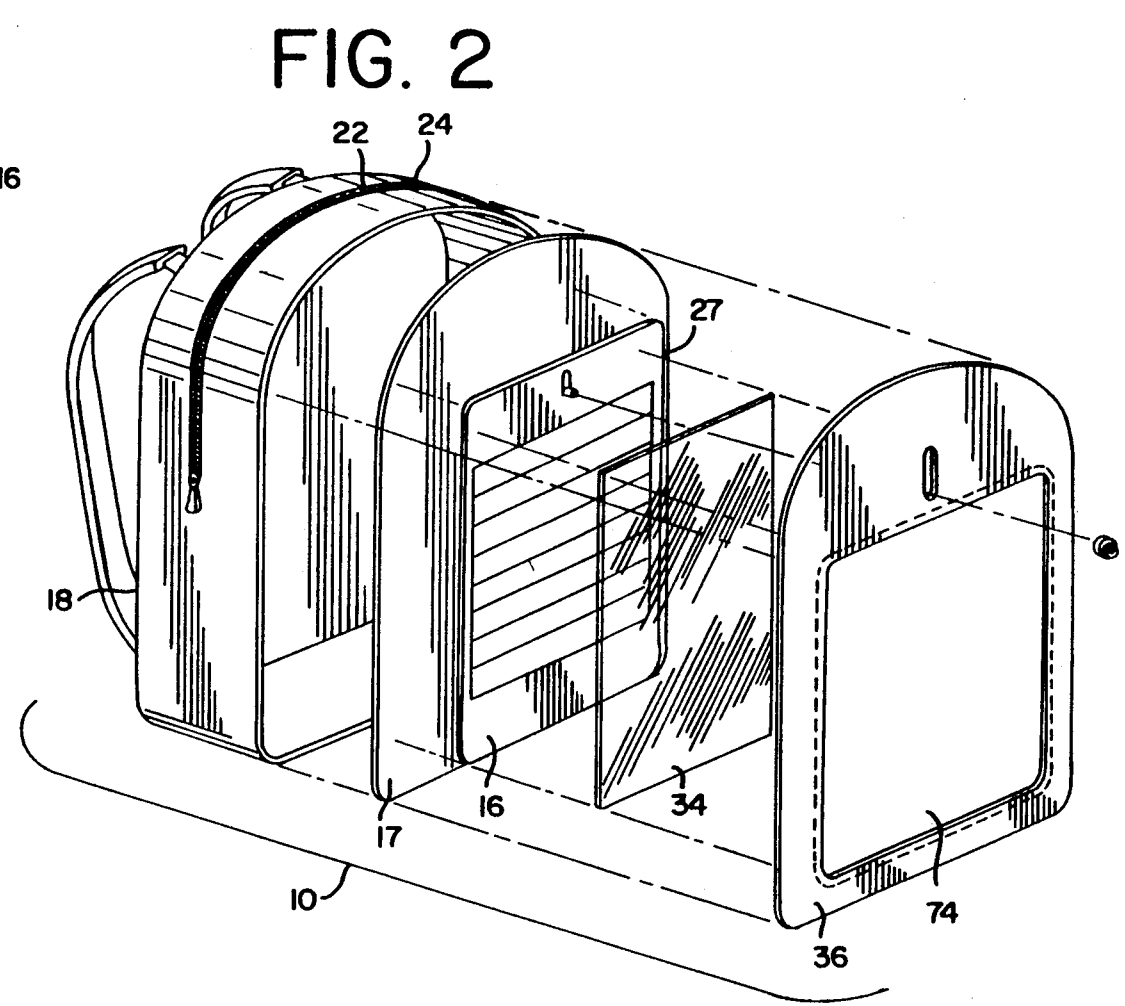
FIG. 2 is an exploded perspective view of the backpack of FIG. 1 showing the positioning of the display unit.
Figure 3:
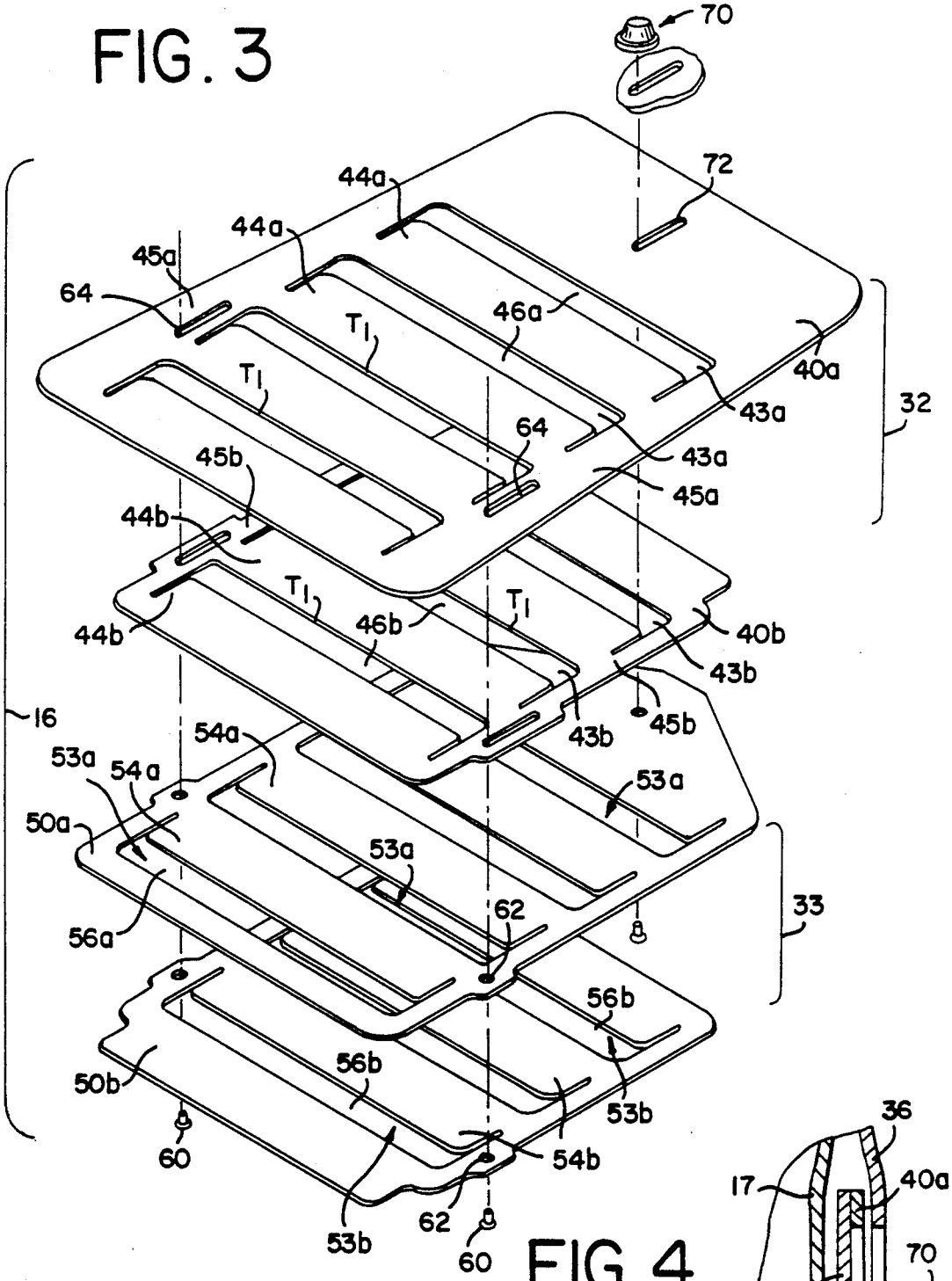
FIG. 3 is an exploded perspective view of the display unit of the backpack of FIG. 2.
Figure 4:
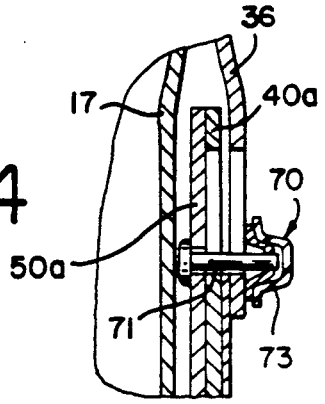
FIG. 4 is a sectional view taken along line 4—4 of FIG. 1.

Turning now to FIGS. 2–4, the display assembly 16 will be explained in greater detail The visual display assembly 16 includes two distinct visual image means, one image means being capable of reciprocatable movement between first and second operative positions and the other image means being stationary.

The stationary design component, or first image means, 32 includes a pair of first image sheets 40*a*, 40*b* each having a series of parallel first visual image segments, or strips 44*a*, 44*b* disposed thereon. Each visual image segment 44*a*, 44*b* is defined by a generally U-shaped slot 43*a*, 43*b*. The image segments 44*a*, 44*b* are further spaced apart from the slot and extend downwardly relative to the bottom of the stationary component 32. Each series of image segments 44*a*, 44*b* are interconnected by marginal strips 45*a*, 45*b* extending transversely to the image segments 44*a*, 44*b* along opposing end portions thereof. Lateral openings 46*a*, 46*b* are disposed between adjoining image segments and are defined by the slots 43*a*, 43*b*. Each image segment contains a portion of a first visual image 100 which is viewable in its entirety when the two first image sheets 40*a*, 40*b* are connected along the marginal strips 45*a*, 45*b* thereof, when joined together in a partially overlapping relationship wherein the trailing edge $T_1$ of each image segment 44*a*, 44*b* overlies a portion of its adjoining image segment. In other words, the image segments 44*a* of one of the first image sheets 40*a* alternatively engage the U-shaped slots 43*b* of the other first image sheet 40*b*. Thus, an entire first visual image 100 is formed.

The moveable design component, or second image means 33 similarly includes a pair of second visual image sheets, or panels 50*a*, 50*b*. Each of these second visual image sheets 50*a*, 50*b* include a series of parallel second visual image segments, or strips 54*a*, 54*b*, each segment of which also being separated by a series of generally U-shaped slots 53*a*, 53*b*. Because the second image segments 54*a*, 54*b* are spaced apart and do not constitute a completed second visual image 110 when viewed alone (being separated by lateral openings 56*a*, 56*b*), the two image sheets 50*a*, 50*b* are joined together along their marginal strips 55*a*, 55*b* in an overlapping fashion whereby the trailing edge is of each second image segment 54*a*, 54*b* overlies a portion of an adjoining second image segment. Thus, a completed second image 110 is formed.

The lateral slots 43*a*, 43*b* and 53*a*, 53*b* present in the stationary and movable design components 32 and 33 permit the two to be interleaved, or mated, together in a manner so as to permit the first and second image sheets to move relative to each other. FIG. 3 illustrates the interleaving of the first and second image means 32, 33, wherein the stationary design component 32 which contains the first visual image 100 substantially overlies the moveable design component 33, which contains the second visual image 110. In this manner, the leading edges of each second visual image segment 54*a*, 54*b* protrude into the stationary design component lateral slots 43*a*, 43*b* of separating adjacent first image segments 44*a*, 44*b*. To ensure and maintain proper registry of the first and second image segments relative to each other, the two design components 32, 33 may be held together by pins 60 which extend through openings 62 and slots 64.

Figure 5:
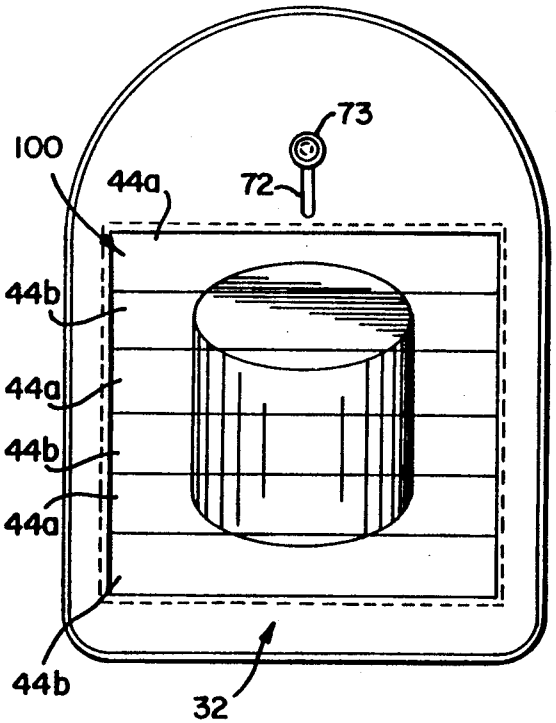
FIG. 5, is an elevational view of the display unit of the backpack of FIG. 1 in a first display position showing a first image.

An actuating mean 70 preferably operatively interconnects the two design components 32, 33 together to permit a user to selectively display either the first visual image 100 or the second visual image 110. The actuating means 70 may include an assembly, such as a post 71 and button 73 attached to the second image means and extending through a slot 72 present in the stationary design component 32. In operation, the first visual image of the stationary design component 32 is displayed when the actuating means 70 is in its first operation position. (FIG. 5) In this position, the second visual image segments 54*a*, 54*b* remain in their interleaved position beneath or behind their counterpart first visual image segments 44*a*, 44*b* and are thus obscured from view. The entire first visual image 100 of the display unit is seen through the protective cover sheet 34 of the article 10.

Figure 7:
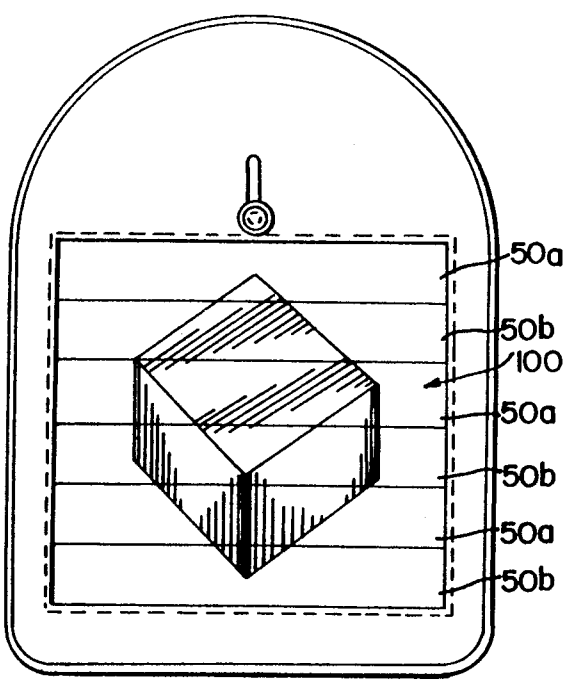
FIG. 7 is an elevational view of the display unit of the backpack of FIG. 1 in a second display position showing a second image; and, FIG. 8 is a exploded perspective view of a second embodiment of a soft luggage article with a changeable visual display unit constructed in accordance with the principles of the present invention.
Figure 6:
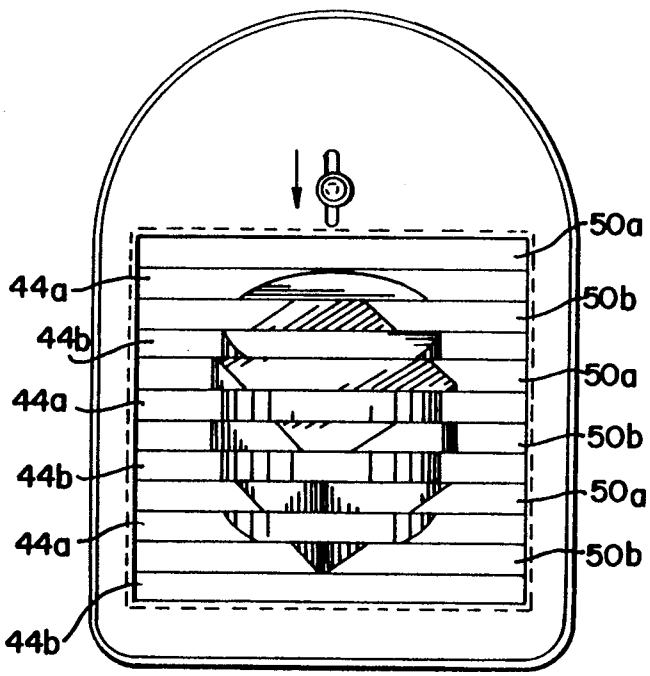
FIG. 6 is an elevational view of the display unit of the backpack of FIG. 1 in an intermediate display position wherein the first image is beginning to dissolve and the second image is beginning to appear.

When the actuating means is moved to its second operative position (downward as shown in FIGS. 6 and 7) the moveable design component 33 is moved out of obscured engagement with the stationary design component 32 such that the second visual image segments 54*a*, 54*b* are extended out from beneath the first image segments 44*a*, 44*b*. In this manner, the second image segments 54*a*, 54*b* extend over the first image segments 44*a*, 44*b* to obscure them from view so that only the second visual image 100 is viewable as a whole from the article 10.

Figure 8:
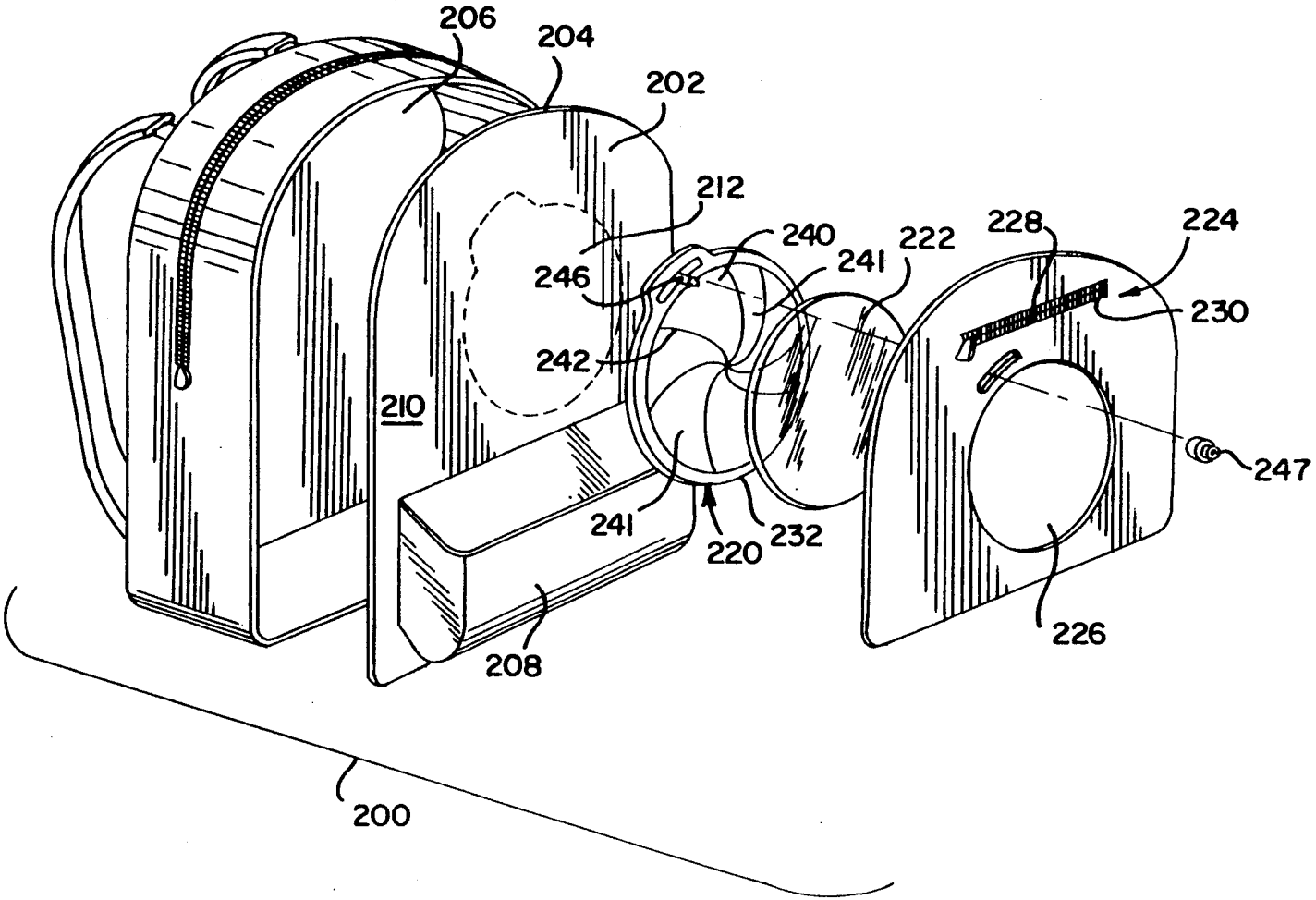

FIG. 8 illustrates another embodiment of a soft luggage article, or backpack 200 with a changeable visual display unit constructed in accordance with the principles of the present invention. The backpack 100 is generally the same in construction as that described above and illustrated in FIGS. 1–7.

The backpack 200 includes a partially planar display surface 202 which forms a sidewall 204 of a first containment pouch 206. The sidewall 204 has a second containment pouch 208 disposed thereon and a predesignated visual display location 212 disposed on the planar portion 202 thereof. The visual display unit 220, illustrated as being generally circular is secured to the planar portion 102 by suitable means and has a transparent cover member 222 associated therewith in overlying relationship. A cover member 224, formed of a similar material as the remainder of the backpack 200 is affixed to the planar portion 202 to contain the circular display unit 220 within an envelope formed between the liner 210 and the cover member 224. As shown, the cover member 224 includes an opening 226 configured to permit viewing of the display unit 220 therethrough.

The backpack 200 may also contain a suitable access means 228, such as a zippered opening 230 which may permit the user to remove the display unit 220 and insert a replacement display unit (not shown) so that the wearer may always, display visual images which are current. In such instances, an appropriate retaining means may be utilized to retain the display unit 220 in place on the planar surface 202, such as by application of a non permanent adhesive means to the rear surface 232 of the display unit 220 to hold the display unit 220 steady when images are being changed by the user.

The construction of the circular display unit 220 is generally the same as the unit illustrated in FIGS. 1–7 in that the unit 220 includes a first image means 240 having a plurality of first image segments 241 arranged adjacent each other in a circular fashion. Each segment 241 is separated from adjacent segments by way of radial lines of separation 242. A second visual image means (not shown) also including a plurality of second image segments is disposed adjacently underneath the first image means 140 such that the first and second visual image segments are disposed in an interleaved relationship in the manner previously described. An activation member 246, having a knob 247 or button, extends outwardly and the movement thereof will cause a corresponding arcuate movement of the first and second visual image segments to selectively from either the first or second visual images.

It will be appreciated that while describing the present invention, the term "backpack" has been used, the present invention is equally applicable to other types of soft luggage and carrying articles where it is desired to display a visual image.

Although the present invention has been described in connection with a plurality of preferred embodiments thereof, many other variations and modifications will now become apparent to those skilled in the art. It is preferred, therefore that the present invention be limited not by the specific disclosure herein but only by the specific claims.

What is claimed is:

1. An article carrier having at least one interior compartment defined by a plurality of side walls, one of the carrier side walls having a substantially planar portion, the planar side wall portion including a receptacle within said side wall, said receptacle including a selectively changeable visual display assembly, the display assembly having a first image means and second image means said first image means including a first image component having a plurality of first image segments, the first image segments forming said first visual image when viewed as a whole, and said second image means including a second image component having a plurality of second image segments, the second image segments forming said second image when viewed as a whole, said first and second image segments being arranged in interleaved fashion, said article carrier further including means for selecting either of said first or second image means, said selecting means being operable between a first and a second operative position wherein said first image means and second image means are respectively displayed on said display assembly.

2. The article carrier of claim 1, wherein said receptacle is defined by two opposing sidewall panels.

3. The article carrier of claim 1, wherein said one of said carrier side walls includes recloseable means for accessing said display assembly.

4. The article carrier of claim 1, wherein said said first image means includes a stationary image component and said second image means includes a moveable image component, the stationary image component including first and second first image sheets, each of the first and second first image sheets having a plurality of parallel first image segments spaced apart from each other by lateral slots, and generally protruding in a first direction, said first and second image sheets being attached to each other in an adjacently overlapping fashion such that at least one of said first image sheet image segments partially overlaps an adjacent image segment of said second image sheet, said stationary image component being fixed within an opening of said one sidewall relative to said second moveable image component, said moveable image component including third and fourth second image sheets, the third and fourth second image sheets each having a plurality of parallel image segments spaced apart from each other by lateral slots, said second image segments generally protruding in a second direction opposite said first direction, said third and fourth image sheets also being attached to each other in an overlapping relationship such that at least one of said third sheet image segments partially overlaps an adjacent image segment of said fourth image sheet, said second moveable image component being held within said one sidewall opening to permit movement thereof relative to said first stationary image component, said visual display unit further including means for selecting either of said first or second visual images, whereby, when said selection means occupies a first operative position said first image segments fully displayed as a whole while said third and fourth image sheet image segments are concealed behind said first and second image sheet image segments and, when said selection means is moved to a second operative position, said third and fourth image sheet second image segments are moveable from their concealed location behind said first and second image sheet first image segments and are fully displayed as a whole and conceal said first and second image sheet first image segments from view, said article carrier further including selection means operable between a first and a second operative position wherein said first image means and second image means are respectively displayed on said display assembly.

5. An article of soft luggage, such as a backpack, the article having a display unit which selectively displays either a first image or a second image, the article including at least first and a second substantially planar sections joined together by an annular section to define article compartment having an interior space;

a third planar section disposed closely adjacent to said second planar section and affixed thereto in a manner to form window means therebetween;

a display unit disposed in the window means, the display unit including a first stationary image component and a second moveable image component, the first stationary image component including first and second image sheets, each of the first and second sheets having spaced-apart first image segments separated by lateral slots, said spaced-apart first image segments generally protruding in a first direction, said first and second image sheets being attached to each other in partial superimposed relationship such that at least one of said first sheet first image segments partially overlaps an adjacent image segment of said second image sheet said first stationary image component being fixed within said window means relative to said second moveable image component, said second moveable image component including third and fourth image sheets, the third and fourth image sheets each having a plurality of spaced-apart second image segments separated by lateral slots, said second image segments generally protruding in a second direction opposite said first direction, said third and fourth image sheets being attached to each other in partial superimposed relationship such that at least one of said third sheet image segments partially overlaps an adjacent image segment of said fourth image sheet, said second moveable image component being held within said window means so as to permit movement thereof relative to said first stationary image component, said visual display unit further including means for selecting either of said first or second visual images, whereby, when said selection means occupies a first operative position, said first image segments are fully displayed as a whole while said third and fourth image sheet image segments are concealed behind said first and second image sheet image segments and, when said selection means is moved to a second operative position, said third and fourth image sheet second image segments are moveable from heir concealed location behind said first and second image sheet first image segments and are fully displayed as a whole and conceal said first and second image sheet first image segments from view.

6. The soft luggage article of claim 5, wherein said window means includes a transparent cover panel.

7. The soft luggage article of claim 5, wherein said first, second, third and fourth image sheets are generally rectangular.

8. The soft luggage article of 5, wherein said stationary image component is fixed within said window means by fastener means.

9. The soft luggage article of claim 5, wherein said third planar section includes a recloseable means for accessing said visual display unit.

10. A backpack having a variable image display assembly which selectively displays either a first or second image, the backpack comprising: a substantially planar front portion, a substantially planar back portion spaced apart from said front portion, the back portion being interconnected to said front portion by an intermediate portion to define a backpack compartment having an interior space; a substantially planar display portion disposed adjacent said front portion and attached thereto to define envelope means therebetween, the envelope means including a selectively changeable display assembly, the display assembly including first image means and second image means in superimposed relationship, the first image means including at least one first image sheet, the second image means including at least one second image sheet, each of said at least one first and second image sheets including a plurality of image segments arranged adjacent each other which when viewed as a whole display a single image, said first image sheet image segments being interleaved between and beneath said second image sheet image segments such that that said first image sheet image segments are concealed from view, means for moving said first image sheet image segments from behind and beneath said second image sheet image segments to thereby display said second image sheet image segments in a manner, whereby said second visual image means is displayed in its entirety and said first image sheet image segments are concealed behind and beneath said second image sheet image segments.

11. The backpack of claim 10, wherein said first image means includes two first image sheets and said second image means includes two second image sheets.

12. The backpack of claim 10, wherein said variable image display assembly is generally circular.

13. The backpack of claim 10, wherein said front portion includes recloseable means for accessing said variable image display assembly.

14. The backpack of claim 10, wherein said variable image display assembly is generally circular and said at least one first and second image sheets are generally circular.

* * * * *